US008429055B1

(12) United States Patent
Dorr

(10) Patent No.: US 8,429,055 B1
(45) Date of Patent: Apr. 23, 2013

(54) METHOD FOR INTERNET BIDDING

(75) Inventor: Robert C. Dorr, Franktown, CO (US)

(73) Assignee: eBay, Inc., San Jose, CA (US)

( * ) Notice: Subject to any disclaimer, the term of this patent is extended or adjusted under 35 U.S.C. 154(b) by 1826 days.

(21) Appl. No.: 09/442,169

(22) Filed: Nov. 16, 1999

Related U.S. Application Data

(60) Provisional application No. 60/152,182, filed on Sep. 2, 1999.

(51) Int. Cl.
*G06Q 30/00* (2006.01)

(52) U.S. Cl.
USPC ..... 705/37; 705/26; 705/27; 705/38; 705/80

(58) Field of Classification Search ..... 705/26, 705/27, 37, 38, 80
See application file for complete search history.

(56) References Cited

U.S. PATENT DOCUMENTS 5,835,896 A * 11/1998 Fisher et al. ..... 705/37
5,890,138 A * 3/1999 Goding et al. ..... 705/37
6,151,589 A * 11/2000 Aggarwal et al. ..... 705/37
6,230,147 B1 * 5/2001 Alaia et al. ..... 705/37
6,272,474 B1 8/2001 Garcia
6,677,858 B1 * 1/2004 Faris et al. ..... 340/573.1

* cited by examiner

*Primary Examiner* — Nga B. Nguyen

(74) *Attorney, Agent, or Firm* — Schwegman Lundberg & Woessner, P.A.

(57) ABSTRACT

A method of Internet bidding wherein a plurality of bidders bid on the item in a first episode of bidding until a deadline occurs. Within a time frame at the deadline, actual bidders from the plurality of bidders are identified and are displayed in a second continued episode of bidding. The time frame is such to identify serious bidders near the deadline and to compensate for Internet communication delays. The second episode of continued bidding is a bidding war among the identified bidders. In a first embodiment, bidding rounds, $T_{BID}$, occur wherein the current high bidder's bid is displayed and the other identified bidders bid against it. In a second embodiment, bidding continues among the identified bidders with the current high bid being displayed. If a predetermined wait time elapses after the last bid, then an enticement multimedia announcement is made to entice further bidding such as: GOING, GOING, GONE!

9 Claims, 10 Drawing Sheets

METHOD FOR INTERNET BIDDING

RELATED INVENTION

This application claims priority to Provisional Patent Application Ser. No. 60/152,182, filed Sep. 2, 1999 and entitled "METHOD FOR INTERNET BIDDING."

BACKGROUND OF THE INVENTION

1. Field of the Invention

The present invention relates to a method of performing bidding in an auction conducted on on-line such as on the Internet.

2. Statement of the Problem

Internet auctions 10 are becoming increasingly popular. One of the most popular is provided by ebay.com. FIG. 1 shows a conventional screen 10 on a computer 1100 of FIG. 11. In the ebay.com auction, bids are accepted until a fixed time out 100 which is set by the person 104 (i.e., seller) auctioning an item 105 (i.e., description). As shown by element 110, a current bid for the item 105 is shown as well as a bid increment 120. Hence, in the example of auctioning off a Colorado map in FIG. 1, the minimum bid 130 is the sum of the current bid 110 and the bid increment 130. The current high bidder is identified 106. Ebay.com has a bidding feature 140 called "proxy bidding." This feature results in ebay.com automatically bidding on the bidder's behalf. When a bidder places a maximum bid 142, the software 1150 keeps the maximum bid secret and only uses a portion of the maximum bid to overcome the current minimum bid 130. Hence, in the example of FIG. 1, and assuming no other maximum bid is in place, then the entry of a $13 maximum bid 142 by bidder X, results in a new screen 10 showing a current bid 110 of $10.49, an increment of $0.50 and a new minimum bid 130 of $10.99. Bidder X is also identified in field 106.

FIG. 2 shows an example of the operation of this prior art approach on a time line 200 based on FIG. 1. In FIG. 2, at time T1, the current bid 110 ($9.99), bid increment 120 ($0.50), and minimum bid 130 ($10.49) are displayed on the monitor 100 of a prospective bidder X. At time T2, a maximum bid 142 ($13.00) is entered by bidder X. At time T3, the proxy bidding software determines and displays the new current bid 110 ($10.49), bid increment 120 ($0.50), and new minimum bid 130 ($10.99). At time T4, bidder Y places a maximum bid 142 of $15. At time T5, the current bid 110 rapidly goes to $13.50. The reason for this is that the proxy bidding software feature 140 of causes bidder Y to outbid the maximum bid ($13.00) of bidder X (by $0.50). While proxy bidding works well in the time period well before the end 100 of the auction, as the auction approaches the end 100, there may be several prospective bidders waiting at their computers 1100 to actively bid. When time 100 occurs, bidding is over.

In this environment, the seller 104 of the item may not receive the full value for the item 105 being auctioned. This is illustrated in another example in FIG. 3, bidder X, at time T1, bids $50 for an item having a bid increment 120 of $5.00. Bidder Y sees the new minimum bid 130 of $55.00 and, at time T2, bids $70. The software 140 determines and displays a new minimum bid 130 of $60.00. Bidder X bids $100 and bidder Z bids $90 at about time T3—both racing to enter bids just before the end occurs at time 100. It is to be understood that bidders are accessing 1130 the auction service 1140 over the Internet 1120 and that delays in Internet servicing can occur which may disrupt the bidding process. In any event and in this example, times T1, T2, and T3 are shortly before the end 100 of the auction. The processing software 140 for the auction processes bidder X's and bidder Z's bids with respect to bidder Y in the fashion described in FIG. 2, and when time 100 occurs, bidder X receives the winning bid $95.00 at time 100 (i.e., $5.00 above bidder Z's bid of $90). Because of the time deadline 100, no further bidding occurs even if bidders X, Y, and Z want to.

Hence, bidders X, Y, and Z may actually be dissatisfied, as they may want to continue bidding. Furthermore, the last bids at T3 (i.e., just before the end 100) may well represent guesses by the bidders. And the owner of the item 105 does not necessarily receive the highest price for the item. Finally, the auction service is denied greater profits since such services are usually compensated based on the final price.

A need exists to emulate true auctioning in Internet auctions wherein in real life auctions, bidders X, Y and Z would be able to continue to outbid each other. In mass auctioning of items over the Internet, this type of real world goal has not been achieved.

SUMMARY OF THE INVENTION

1. Solution to the Problem

The present invention solves the above-stated problem by providing real life auctioning for an auctioned item thereby resulting in the highest possible value to the owner of the item being auctioned in an Internet environment, greater satisfaction to the bidders, and greater profit for the auction service.

2. Summary

A method of Internet bidding wherein a plurality of bidders bid on the item in a first episode of bidding until a deadline occurs. Within a time frame at the deadline, actual bidders from the plurality of bidders are identified and are displayed in a second continued episode of bidding. The time frame is such to identify serious bidders near the deadline and to compensate for Internet communication delays. The second episode of continued bidding is a bidding war among the identified bidders. In a first embodiment, bidding rounds, $T_{BID}$, occur wherein the current high bidder's bid is displayed and the other identified bidders bid against it. In a second embodiment, bidding continues among the identified bidders with the current high bid being displayed. If a predetermined wait time elapses after the last bid, then an enticement multimedia announcement is made to entice further bidding such as: GOING, GOING, GONE!

DETAILED DESCRIPTION OF THE INVENTION

1. Overview.

Figure 4:
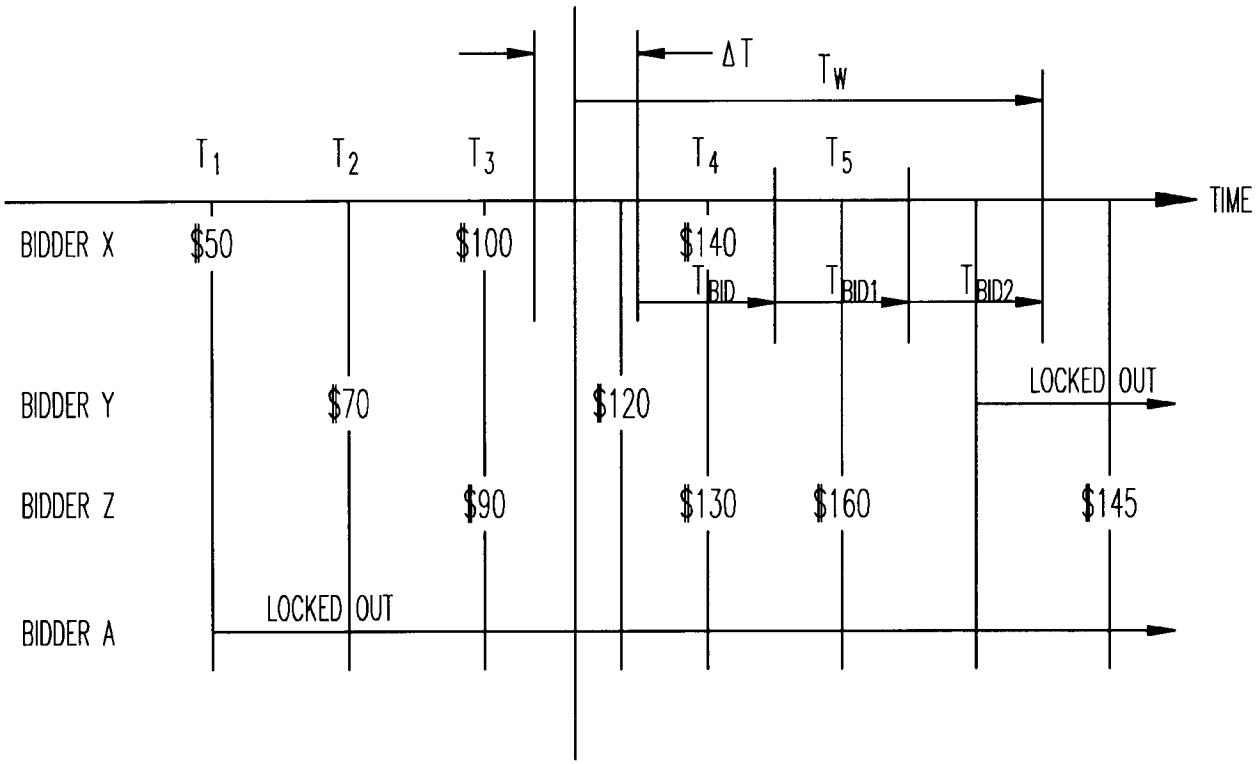
FIG. 4 is an example of the bidding war process of the present invention.

In FIG. 4, a window of time $T_W$ is preferably provided after the time deadline 100. The purpose of window $T_W$ is to entice bidders to continue bidding on the particular item 105. This is quite common in real life auctions where an auctioneer settles in on two or three bidders and actually starts talking to the bidders to encourage them to continue bidding. In order to implement this real life situation into Internet auctioneering, the window $T_W$ is provided. In the preferred embodiment, at time 100, the software starts a window $T_W$ of indeterminate time length. In other embodiments the window, $T_W$, is fixed in length.

Figure 11:
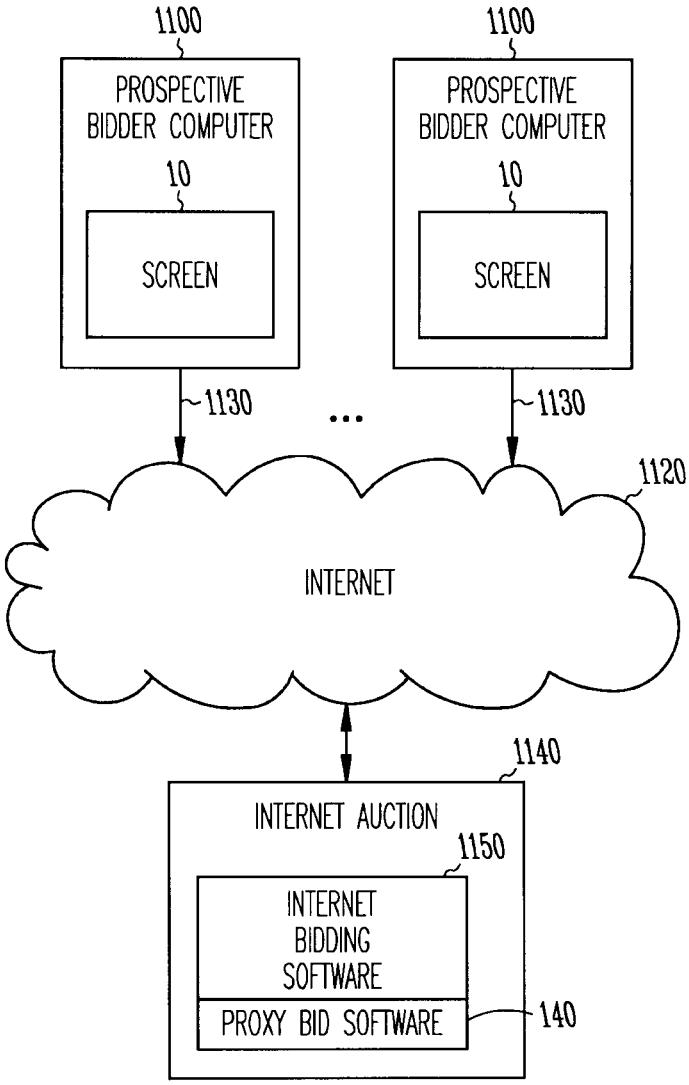
FIG. 11 sets forth the Internet auction service as implemented over the Internet which is prior art.

In FIG. 11, perspective bidder computers 1100 have access 1130 over the Internet 1120 to an Internet auction 1140. In the Internet auction resides Internet bidding software 1150 which will be subsequently described in detail with reference to FIG. 6.

2. Identification of Bidders.

The software of the present invention, in the preferred embodiment, identifies bidders, such as by way of example, bidders X, Y and Z in FIG. 4 as having placed bids in a ΔT time frame which may be a time period before deadline 100, a time period after deadline 100, or a combination of time periods before and after. The use of ΔT is optional, but preferred due to Internet delays that often occur in bidders placing bids. For example, ΔT could be any suitable time such as one hour (or one day, ten minutes, forty seconds, 1 second, etc.) in which all bidders are identified for subsequent bidding in time window, $T_W$.

In one variation, an e-mail can be automatically sent to each identified bidder during time ΔT informing the bidder of the opportunity to bid in the window, $T_W$.

In another variation of the present invention, all previous bidders for the item 105 being auctioned could be identified to participate in the additional bidding in time window, $T_W$. Hence, if the bidders for an item being auctioned totaled eight, during a three-day auction ending at time 100, those eight would be identified and listed so as to bid in the window of time, $T_W$.

However, the preferred embodiment provides a short period of time such as ΔT equals, for example, seven minutes (five minutes before time 100 and two minutes after time 100) in order to continue the active bidding for the item 105 by those interested bidders. This provides a ΔT of sufficient length to identify those serious bidders before the deadline 100 and to compensate for those serious bidders who bid near the deadline and would normally be beyond the deadline due to possible communication delays in the network. It is to be understood that any suitable ΔT could be utilized under the teachings herein such as: 1 sec to 10 min before, after, or before and after when identifying serious bidders and when compensating for communication delays.

3. Entering New Bidding Round.

Figure 5A:
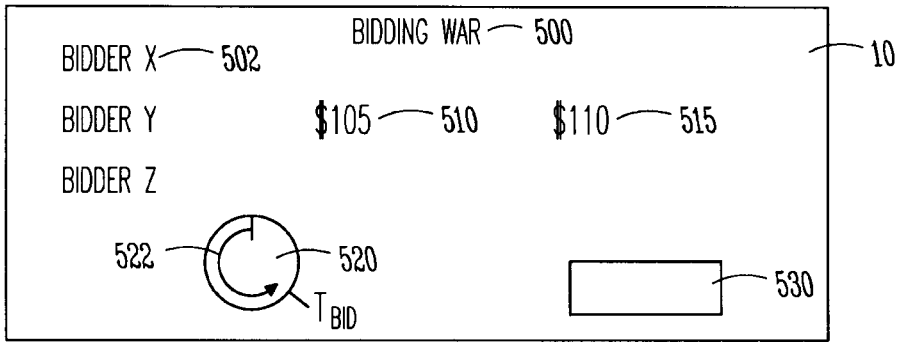
FIG. 5 are screen examples of FIG. 4.
Figure 5B:
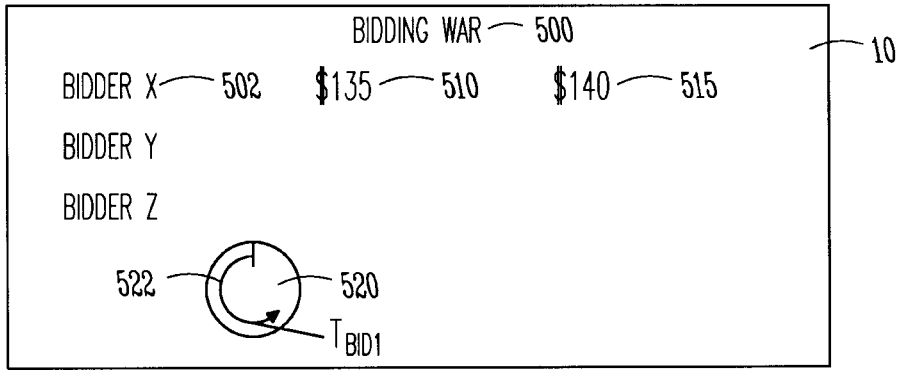
Figure 5C:
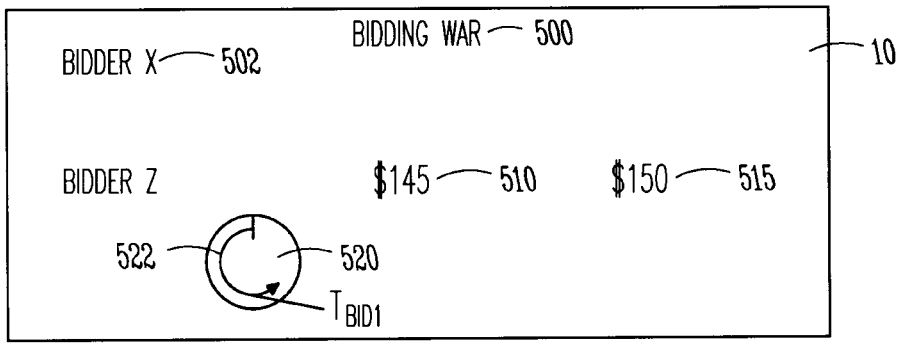

The present invention provides new information in screen 10 for the auctioned item 105. It includes graphics, text, and, optionally, sounds. This will be illustrated in the following by way of example. As shown in FIG. 5(*a*), the monitor screen 10 for the item 105 at auction can change to announce, for example, that a bidding war 500 is about to take place and that bidders X, Y and Z, for example, are the bidders 502 identified during ΔT to participate in the bidding war. Bidders X, Y, and Z are listed 502 on the screen 10. The screen 10 announces or shows that bidder Y has the current high bid of $120 such as shown at 510.

It is to be understood that any suitable screen presentation can appear on screen 10 announcing the additional bidding that occurs between identified bidders. This can be termed, as shown in FIG. 5(*a*) as a bidding war, a "face off," or any suitable multimedia announcement of continued bidding among the identified bidders, in the preferred embodiment. The software of the present invention then allows a period of bid time $T_{BID}$ in which to accept bids, such as in the example, from bidders X and Z and this period of time may be graphically shown by a clock ticking down such as shown by graphics 520 and the arrow 522. The amount of time $T_{BID}$ for clock 520 to tick down can be any suitable period of time such as, but not limited to, 10, 20, or 30 seconds. Again, any suitable multimedia presentation can be displayed on the screen 10 to all viewers of the item being auctioned. This adds excitement not only to the identified bidders, but also to others watching the bidding war in progress. For example, as the clock 520 ticks down, standard auctioneering words such as "going, going, going, gone!" could be used visually and/or audibly. This feature can be implemented in any type of Internet auction with or without the other features of the present invention.

Figure 1:
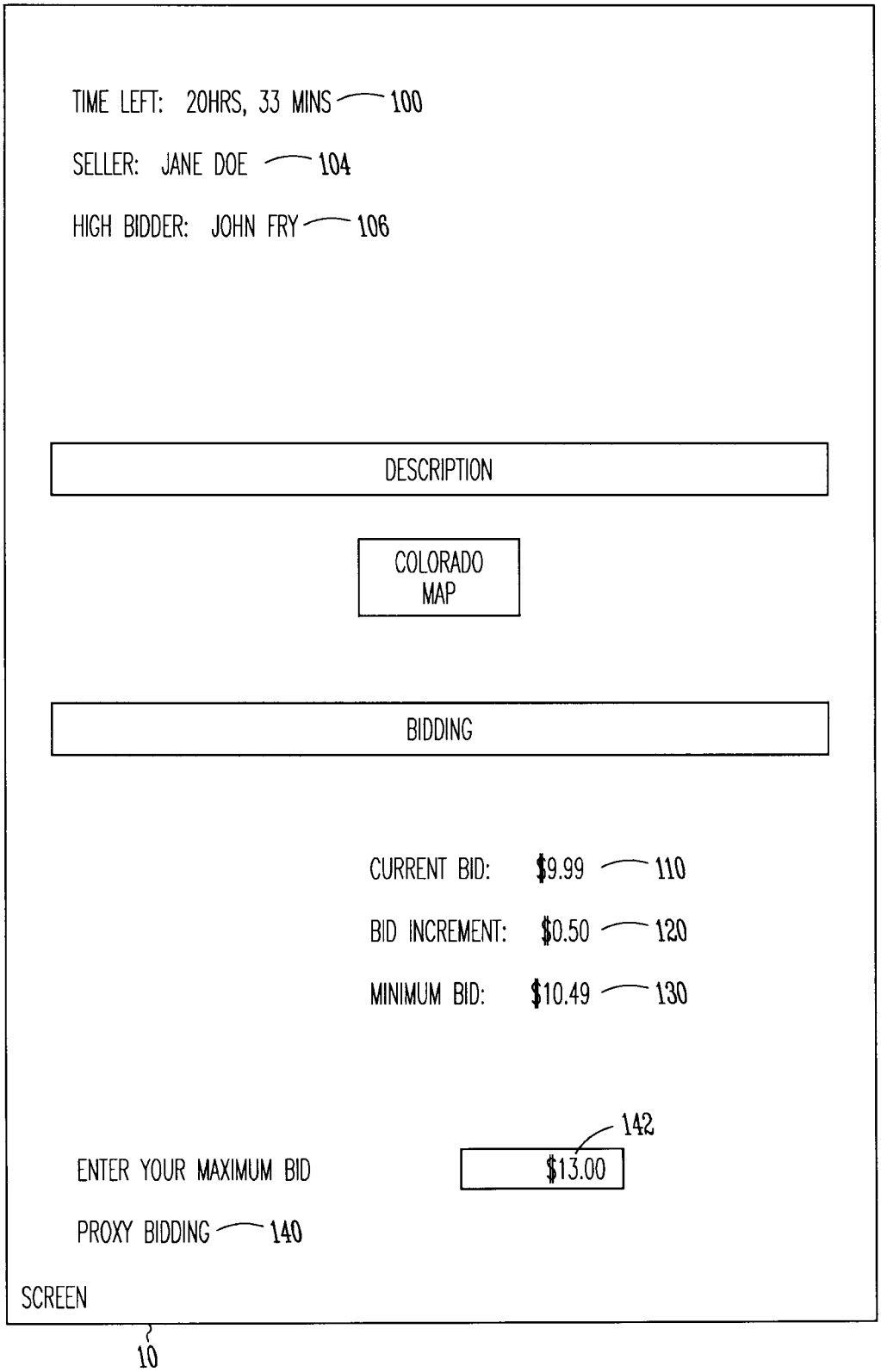
Fig. 1 (Prior Art)
FIG. 1 is a prior art auction service on the Internet.
Figure 2:
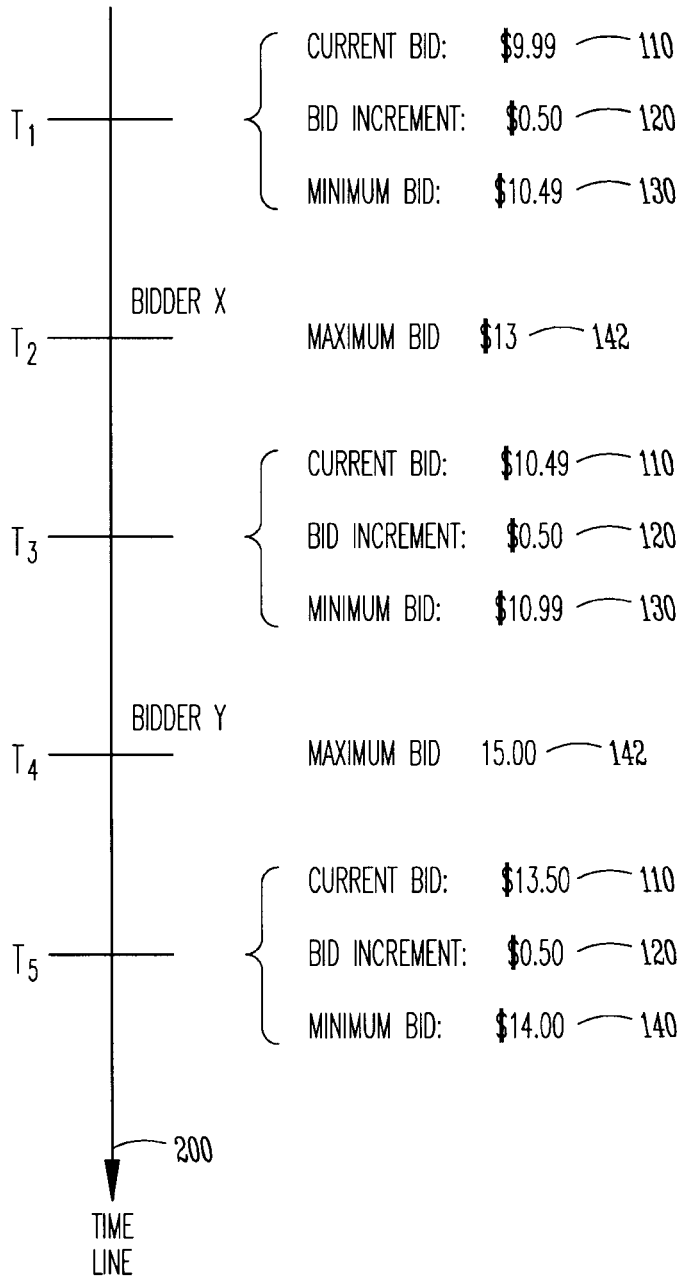
Fig.2 (Prior Art)
FIG. 2 is the prior art process of proxy bidding for the service of FIG. 1.
Figure 3:
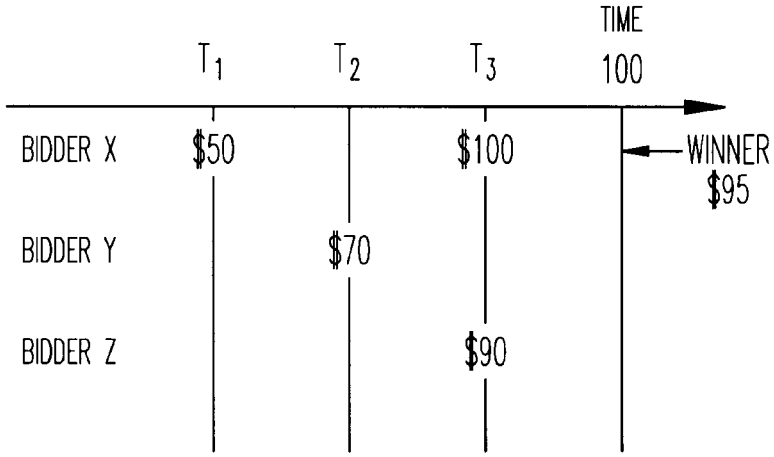
Fig. 3 (Prior Art)
FIG. 3 is an example of the prior art process of proxy bidding.

FIG. 4 is based on the prior art example of FIG. 3. Bidder Y hurries to place a bid of $120 but it arrives just after time 100 occurs which, in the prior art approach of FIG. 3, would be ignored. Bidder Y's bid is in the ΔT time frame, however, for this example (i.e., within two minutes after time 100). Under the teachings of the present invention, window $T_W$ starts and the screen displays the bid of $105 (at 510) plus the increment of $5.00 to be a new minimum bid of $110 (at 515). (Remember, in this example, that in FIG. 3 Bidder X, at time $T_3$, bid $100. So Bidder Y is the current high bidder at $100+$5=$105) based on a proxy bid of $120. The posted bid of Y causes the timer 520 to start timing down for a time period, $T_{BID}$. In FIG. 4, assume at about time T4, that bidder X bids $140 and bidder Z bids $130. During the $T_{BID}$ time period, bids are only received from bidders X and Z. Now as shown in FIG. 5(*b*), the screen 10 shows X to be the high bidder at $135 (i.e., $5 over the bid by Y of $130) so that a new minimum bid 515 of $140 is shown on the screen. The clock 520 starts $T_{BID1}$. The bidding is now between Y and Z during a new time period, $T_{BID1}$, with bidder X locked out.

Assume as shown in FIG. 5(*c*), during the next time period $T_{BID1}$, at time T5, bidder Z bids $160. However, bidder X in $T_{BID}$ has a proxy bid of $140. Bidder Y does not place a bid during $T_{BID1}$. At the end of $T_{BID1}$, bidder Z is the high bidder at $145 (i.e., the earlier bid of X of $140 in FIG. 4 at time $T_4$ plus a $5.00 increment).

Because bidder Y failed to bid in $T_{BID1}$, bidder Y is permanently locked out in $T_{BID2}$. Bidder Y is, in one variation, no longer shown on the screen 10. Bidder X is now given the opportunity to bid during $T_{BID2}$ which he does not do and, therefore, bidder Z becomes the high overall bidder at $145 and receives the auctioned item 105.

In the above example, three separate time periods, $T_{BID}$, occurred during the time window $T_W$. Any number of time periods $T_{BID}$ could be encountered depending on the number of bidders, the continuation by the bidders to bid in each subsequent round, etc. In this embodiment, the time window $T_W$ is generally a multiple of the $T_{BID}$.

All of the above is one preferred embodiment of the present invention. Another preferred embodiment operates as follows under the teachings of the present invention. Once the bidding ends at time 100, time window $T_W$ starts. All bidders that are identified 502 on screen 10 can continue bidding just as they did before the deadline time 100. In order to determine when the new bidding round should be terminated, in this embodiment, after each bid the software times out a first internal period of time and, if no additional bid is received from any of the identified bidders, the clock 520 (or something similar to it) can suddenly be displayed on the screen 10 for the auctioned item 105 with, optionally, the sound "going, going, going, gone!". Should another bid be received, then the process of bidding continues until once again the internal time period times out to once again provide a clock appearance 520 for another "going, going, going, gone!" signal. In this embodiment, this provides an end to the new bidding round and also provides interactive excitement to the bidders and to those watching. In this embodiment, the time window, $T_W$, is of indeterminate length. Rather than have a number of separate bidding rounds $T_{BID}$ as discussed above in the first preferred embodiment, in this the second preferred embodiment, as the new bidding round $T_W$ is entered, bidding occurs normally, but when bidding starts slowing so that the first internal time period does not detect a new bid within a predetermined period of time such as fifteen seconds, then all bidders are given an opportunity to bid once again in which case aggressive bidding can once again be renewed or, if there are no additional bids when the clock 520 times down, then the auction is over and the successful bidder receives the auctioned item.

It is to be expressly understood that messages 730 could also be delivered onto the screen for the auctioned item encouraging bidding to take place. It can be appreciated that with a number of bidders who are qualified to bid in window $T_W$, that the length of time for the window $T_W$ could be extended. Indeed, the bidding could become hectic.

The owner of the item being auctioned receives a much higher price than the prior art approach and additional excitement is given to the bidding process. Furthermore, the bidders have the opportunity to actually bid to obtain the item 105. Of course, any other bidders watching the monitor screen are locked out such as bidder A in the example of FIG. 4. In yet another variation, the other bidders such as A could be allowed to bid if, for example, they paid an entry fee.

4. Software.

Figure 6:
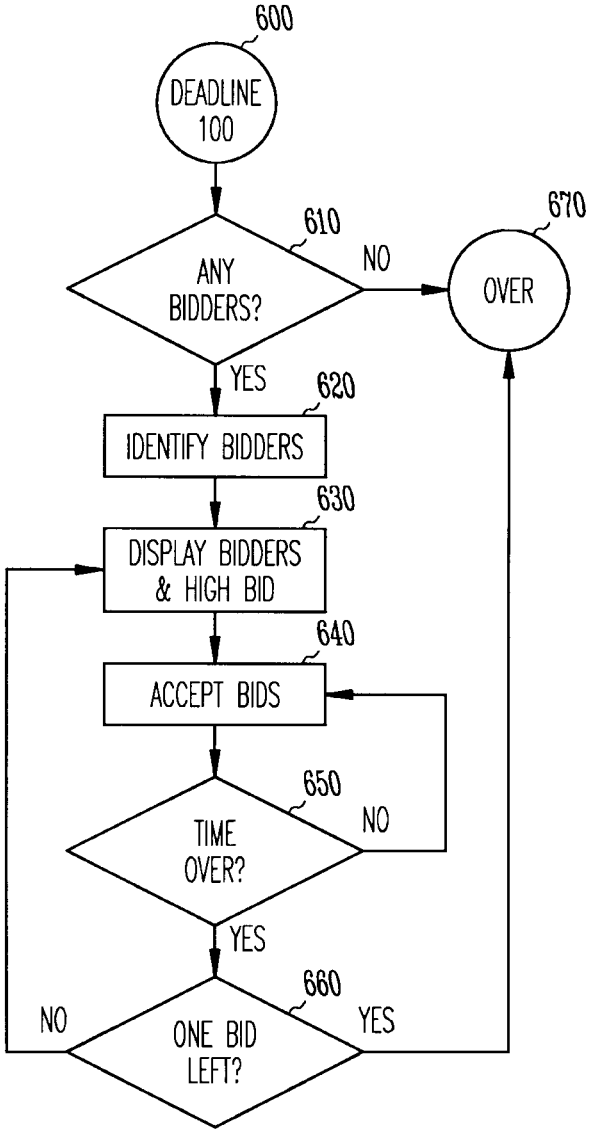
FIG. 6 is a flow chart of a first preferred embodiment of the bidding war of the present invention.

In FIG. 6, the method of the first embodiment of the present invention is set forth. Stage 100 is the conventional occurrence of time 100 and is the start of the method of the present invention. Stage 610 is entered to determine if any bidding was present in the ΔT time frame. If no bidding was present, then the method is over in stage 670. If bidders are present in the ΔT time frame, then their identities are obtained in stage 620. In some embodiments of the present invention stages 610 and 620 could be a single stage.

Stage 630 is now entered and the various displays 500, 510, 520, and 530 are provided. In stage 630, the current high bid 510 and high bidder are shown. The bid increment 120 and the minimum bid 130 are not used, but in variations of the present invention can be used. All bidders, other than the high bidder, are now provided the opportunity to bid during time, $T_{BID}$. Stage 640 receives these bids and holds these bids until $T_{BID}$ over in stage 650. When stage 650 is over, then stage 660 is entered. If only one bid was received, then that bidder wins, a suitable announcement made and stage 670 is entered. If more than one bid was received, then stage 630 is entered and the process (i.e., stages 630, 640, 650 and 660) repeats until one bid is left.

A first variation to this method is to continually accept bids from each remaining bidder in stages 640 and 650 until time $T_{BID}$ is over. Hence, a bidder could increase his/her own bid if time permits.

A second variation to this method is to let the high bidder also bet with the remaining bidders as this might speed-up the bidding process.

Figure 7:
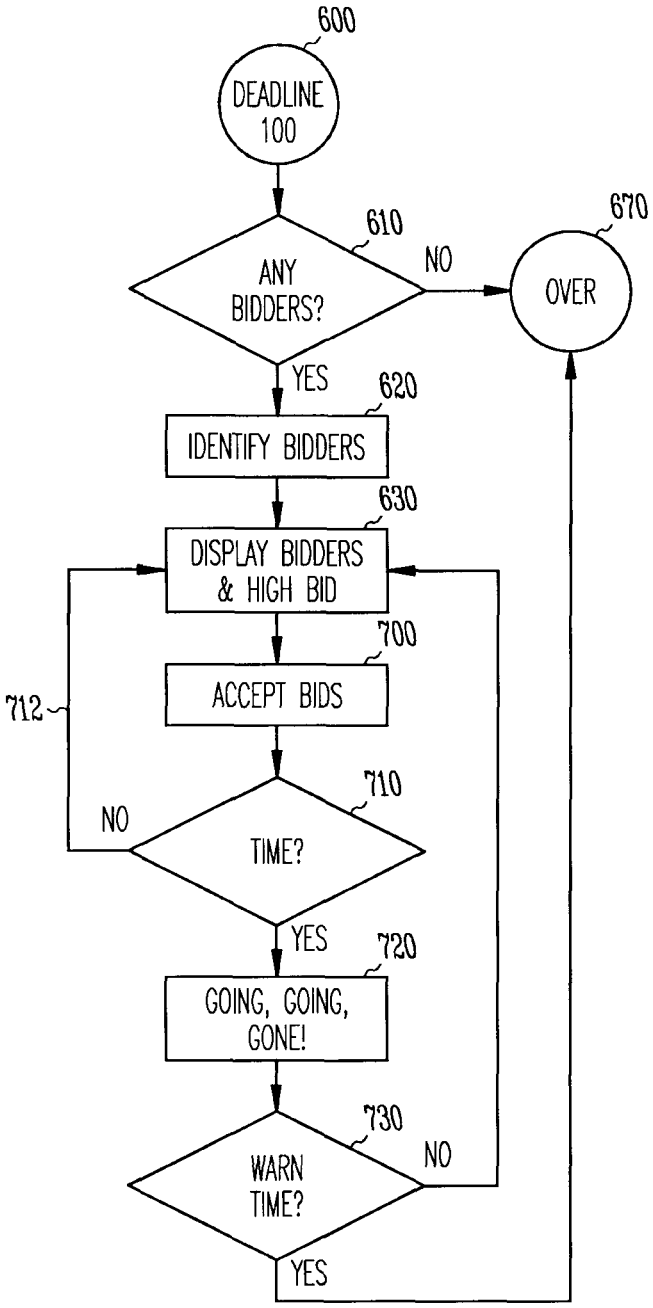
FIG. 7 is a flow chart of a second preferred embodiment of the bidding war of the present invention.

In FIG. 7, the second preferred embodiment of the present invention is set forth. Like functional stages are identified with respect to FIG. 6. With FIG. 6, in stage 630, the identified bidders and the high bid, bid increment, and minimum bid are all displayed on screen 10. In this second embodiment, the software of the present invention now accepts bids from all identified bidders in the same fashion as bidding occurred prior to time 100. The proxy bidding 140 conventionally operates and this occurs in stage 700. However, a first internal timer 710 is used so that after a bid is accepted and displayed as the current winning bid, a period of time such as 15, 30, 45, 60 seconds, etc. is timed down. If, during this stage 710, another bid comes in, then path 712 is entered and that bid is normally processed. Time 710 is reset and the process continues to evaluate each incoming bid. However, when a bid is received and displayed in screen 10 and the timer 710 times out, then stage 720 is entered. A new multimedia presentation appears on screen 10 (not shown in the figures) which provides in stage 730 a clock 520 (or other graphic representation) to inform all bidders that the auction is nearing its end but will receive any additional bids for the time shown in the clock 520. Again, this can be any suitable time such as 5, 10, 15, 20, 35, 60 seconds, etc. If a bid comes in during this time period shown by clock 520, then the new bid is displayed in stage 630 and the aforesaid process repeats. It is to be expected that the bidding war re-ignites with a flurry of bids from some or all of the identified bidders. However, if the clock 520 times out, then stage 670 is entered and the bidding for this item is over.

It is to be expressly understood that in variation to this second preferred embodiment, that when deadline 100 occurs in stage 600, that stage 630 is entered, and that stages 610 and 620 are skipped. In this embodiment, the bidders are not separately identified at time deadline 100. Rather, bidding simply continues at deadline time 100 with a notice to the bidders that any bidders who continue to bid will have their bids accepted provided that the bids are timely made. In this variation, any bidder at the end of the auction can enter the bidding war as it is not limited to those who are identified. What causes the auction to actually end is the timing sequence of 730. The provision of the time period 710 is simply to prevent the use of stage 720 from being an annoyance in being triggered too often. However, this does not limit the teachings of the present invention since in some variations the time stage 710 could be eliminated.

Other variations, which do not depart from the teachings of the present invention, include the following. The Proxy Bidding feature 140 of ebay.com need not be used. In this variation, on-line bidders would actually have to outbid each other as this would not be done as a software feature.

In another variation, and with reference to FIGS. 5(*a*), (*b*), and (*c*), the bid from each bidder can be shown on the screen 10. This visual representation of each bid would work in an environment without, the proxy bidding feature. Hence, and with reference to FIG. 4, during time $T_{BID}$ (at time $T_4$) the actual bid of each bidder would be shown in comparable areas 510. Hence, in this area each bidder could easily see what other bidders are bidding and simply outbid.

Many variations to the multimedia presentation could be used for the presentation of the clock 520.

In FIG. 4, the actual start of time $T_W$ is at or near the end of time ΔT.

In another variation, all bidders for an item 105 before the deadline 100 are identified to participate in the subsequent bidding. In this variation, those identified bidders not actually bidding in the first $T_{BID}$ round of FIG. 6, would be locked out. When this variation is used in the embodiment of FIG. 7, then the subsequent bidding process results from only the identified bidders who actually bid.

5. Proxy Bid Mapping.

On line auctioning operates well when each prospective bidder continually monitors the auction of an item. Unfortunately, in the real world, this is essentially an impossible task. First, it is not uncommon for a prospective bidder to be bidding in a number of auctions. Second, sellers may have a deadline time that is inconvenient to a prospective bidder (for example, the prospective bidder may be asleep). Or, the prospective bidder may have tasks elsewhere such as a job. A need exists for a prospective bidder to be able to place prospective bids in the future through a mapping technique.

Figure 8:
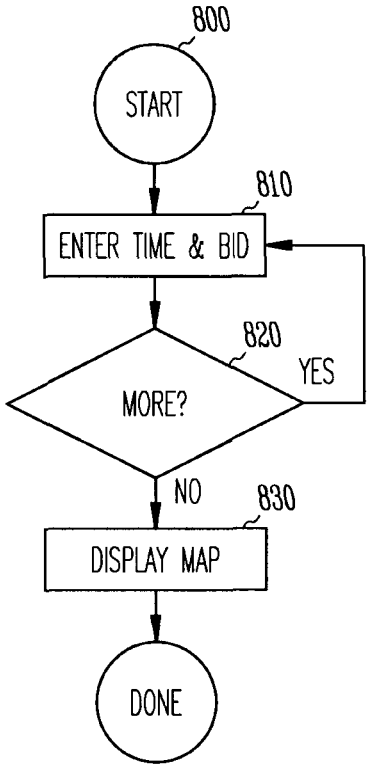
FIG. 8 is a flow chart of the proxy bid mapping of the present invention.
Figure 9:
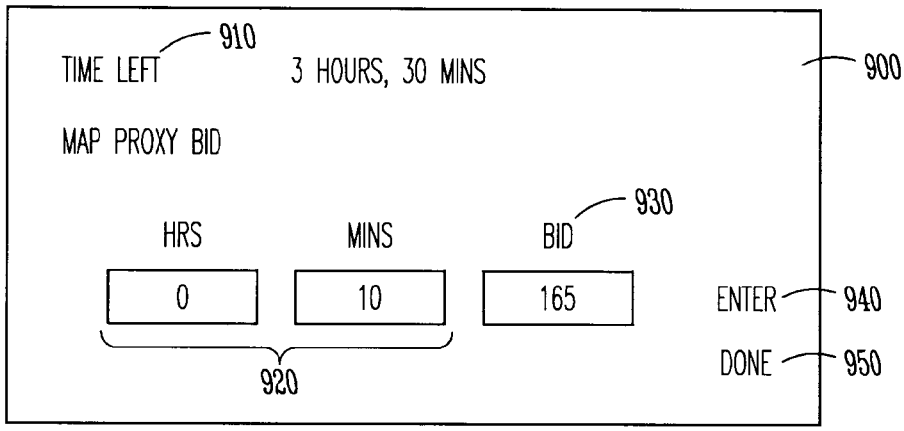
FIG. 9 is an example of the mapping for the process of FIG. 8.

In FIG. 8, the flow of the mapping method of the present invention is set forth. In stage 800, a bidder enters the method by clicking on an appropriate icon on the screen such as "MAP BIDDING." Any suitable icon can be utilized whether letters, graphics, numbers, or combinations thereof. Once stage 800 is entered, a screen 900 such as shown in FIG. 9 can be displayed to a bidder. This may be a separate screen or simply a portion of an existing screen. The bidder is shown the time left 910 for the item being auctioned and time fields 920 which can be filled in.

Figure 10:
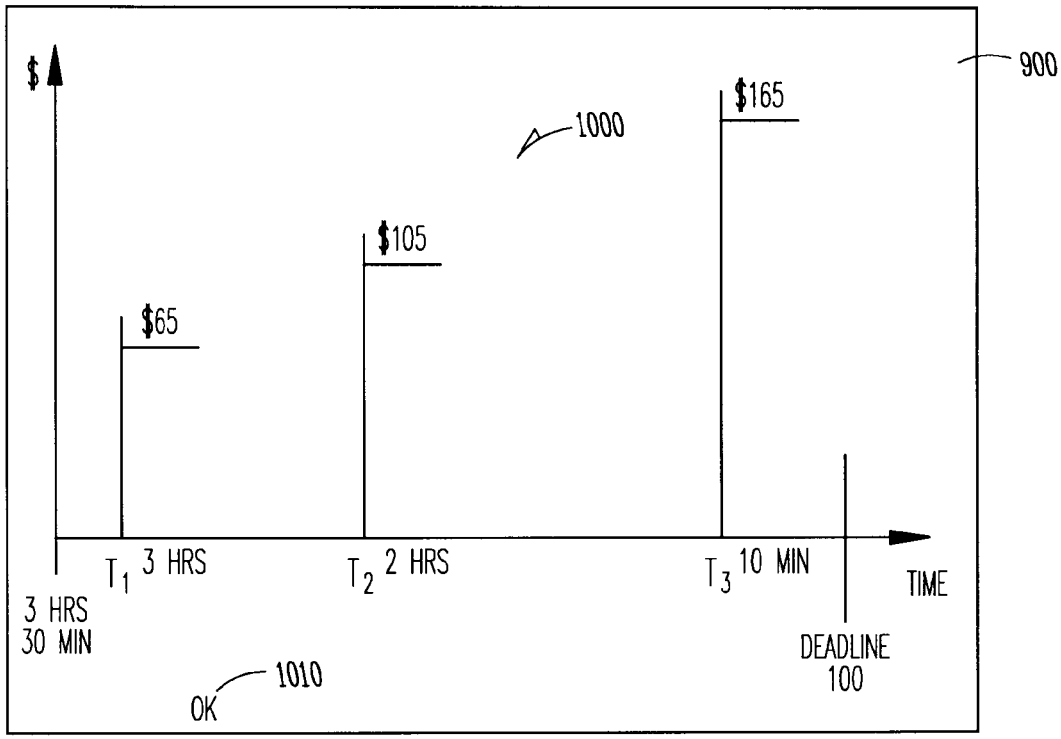
FIG. 10 is a map based on FIG. 9.

In stage 810, the bidder enters a bid time in hours and minutes into fields 920. In the example shown in FIG. 9, three hours and thirty minutes are left 910. And, as shown in FIG. 9, only ten minutes is entered. In this example, the bidder wants to place a proxy bid ten minutes before the deadline time. In field 930, the bidder enters the amount of the bid which is shown to be $165 in this example. The bidder then clicks on an icon such as ENTER 940 to enter the time 920 and the bid 930. This occurs in stage 810. The method then enters stage 820 to determine whether more time and bid amounts are to be entered. If the bidder enters in new time 920 and a new bid amount 930 and again hits the enter icon 940, then stage 810 is reentered. Otherwise, if the bidder clicks on a DONE icon 950, then stage 830 is entered and a map 1000 such as shown in FIG. 10 is displayed on the screen. In map 1000, the times and the amounts of each bid are shown. In the example of FIG. 10, a bidder has placed three separate time and amount bids. At time $T_1$ (3 hours before the deadline 100), the bidder has placed a bid of $65. At time $T_2$ (2 hours before the deadline time), a bid of $105 has been made. Finally, at time $T_3$ (ten minutes before the deadline time), a bid of $165 has been made. This is simply an example but illustrates the operation of the method of the present invention.

As set forth in FIG. 8, any number greater than one of time entries 920 can be made. Each time entry 920 has a corresponding bid amount 930. Furthermore, the deadline time can significantly vary from a few hours to many days.

For example, it may be that a deadline 100 occurs when a bidder has to attend an important function and yet does not wish to miss placing a final bid on a particular item. Yet, the bidder does not want other bidders to know too far in advance what his/her bidding strategy is. Therefore, even though unavailable to do so, a bidder may program in a single future bid one or two minutes before the deadline time.

This technique increases the bidding activity for a particular item thereby making it more profitable for on-line auction services and for sellers. This mapping technique is not limited to proxy bidding but can be any type of bidding. It also adds excitement and strategy to the bidding process for prospective buyers.

The mapping technique presented above can be used alone or in combination with the bidding war invention discussed above.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

I claim:

1. The method for placing on-line bids over the Internet during an auction of an item, in an Internet auction said method comprising:

entering, during the Internet auction, over the Internet at least one future time, from a bidder, for placing a bid for the item before the auction deadline, entering over the Internet a bid amount for the item from the bidder to be placed at each at least one entered future time before the auction deadline, placing the bid for the item at the entered bid amount when each at least one entered future time occurs.

2. The method of claim 1, further comprising:

ending the bidding on the item at a deadline time displayed on a screen display for the item for the bidder and one or more other bidders;

identifying on the screen display only bidders from the bidder and the one or more other bidders for the item making bids over the Internet within a time frame of the deadline time in each computer for the plurality of bidders; and continuing bidding, in the Internet auction, over the Internet with only the identified bidders in at least one window of time after the deadline time until one of the identified bidders obtains a high bid for the item.

3. The method of claim 2, further comprising:

locking out, in the Internet auction, all remaining identified bidders from the bidder and the one or more other bidders failing to place a bid in the step of continuing the bidding.

4. The method of claim 2, wherein the time frame is a predetermined period of time before, after, or before and after the deadline time.

5. The method of claim 2, wherein the time frame compensates for communication delays on the Internet.

6. The method of claim 2, further comprising displaying on the display screen the predetermined bid time period.

7. A non-transitory machine-readable medium comprising instructions, which when implemented by one or more processors, perform the following operations:

entering, during the Internet auction, over the Internet at least one future time, from a bidder, for placing a bid for the item before the auction deadline;

entering over the Internet a bid amount for the item from the bidder to be placed at each at least one entered future time before the auction deadline; and placing the bid for the item at the entered bid amount when each at least one entered future time occurs.

8. The non-transitory machine-readable medium of claim 7, the operations further comprising:

ending the bidding on the item at a deadline time displayed on a screen display for the item for the bidder and one or more other bidders;

identifying on the screen display only bidders from the bidder and the one or more other bidders for the item making bids over the Internet within a time frame of the deadline time in each computer for the plurality of bidders; and continuing bidding, in the Internet auction, over the Internet with only the identified bidders in at least one window of time after the deadline time until one of the identified bidders obtains a high bid for the item.

9. The non-transitory machine-readable medium of claim 8, the operations further comprising locking out, in the Internet auction, all remaining identified bidders from the bidder and the one or more other bidders failing to place a bid in the step of continuing the bidding.

* * * * *